US006964361B2

(12) United States Patent
Kathrein

(10) Patent No.: US 6,964,361 B2
(45) Date of Patent: Nov. 15, 2005

(54) WIRELESS DEVICE CARRYING APPARATUS AND METHOD

(75) Inventor: Michael A. Kathrein, Henderson, NV (US)

(73) Assignee: B.M.J., Inc.

( * ) Notice: Subject to any disclaimer, the term of this patent is extended or adjusted under 35 U.S.C. 154(b) by 0 days.

(21) Appl. No.: 10/141,393

(22) Filed: May 9, 2002

(65) Prior Publication Data

US 2003/0209578 A1 Nov. 13, 2003

(51) Int. Cl.[7] ..... A45F 3/14

(52) U.S. Cl. ..... 224/183; 197/199; 197/269; 197/271; 197/666; 197/669; 197/675; 197/930

(58) Field of Search ..... 224/183, 197, 224/199, 269, 271, 666, 668, 669, 674, 675, 930; 24/3.6, 303; 206/818

(56) References Cited

U.S. PATENT DOCUMENTS 1,368,156 A * 2/1921 Jackson ..... 24/3.6
2,731,663 A * 1/1956 Thompson ..... 24/303
4,771,927 A * 9/1988 Ventura ..... 224/666
5,050,276 A * 9/1991 Pemberton ..... 24/303
5,664,712 A * 9/1997 Smrt ..... 224/269
5,845,373 A * 12/1998 Langer ..... 24/303
5,865,482 A * 2/1999 Aoki ..... 24/303
6,182,878 B1 * 2/2001 Racca ..... 224/930
6,598,272 B2 * 7/2003 Nire ..... 24/303

* cited by examiner

*Primary Examiner*—Gary E. Elkins
(74) *Attorney, Agent, or Firm*—Weiss, Moy & Harris, P.C.

(57) ABSTRACT

A carrying apparatus and method for a wireless device. The apparatus has a first mating portion coupled to a wireless device case and a second mating portion coupled to a personal item, such as a belt. The first and second mating portions are coupled to each other by the positioning of a magnet proximate the surface of at least one—and preferably both—of the first and second mating portions. Bringing the first and second mating portions into sufficient proximity causes them to be coupled, and permits the use of the apparatus for carrying. When the wireless device needs to be removed for use, a pulling action will separate the first and second mating portions.

20 Claims, 2 Drawing Sheets

WIRELESS DEVICE CARRYING APPARATUS AND METHOD

FIELD OF THE INVENTION

This invention relates generally to wireless devices and, more particularly, to an apparatus and method for carrying a wireless device on a belt, purse, bag, or the like.

BACKGROUND OF THE INVENTION

Wireless devices, including telephones, beepers, pda's, and the like, are often carried in a manner that will facilitate ready access to the device when needed. Thus, there are a variety of apparatuses that permit the attachment of a case for a wireless device to a belt, purse, bag, or the like. A typical such apparatus consists of a case for the wireless device, which case has a clip on a rear side thereof to be attached to a belt or the like.

It is preferred that an apparatus of this type provide for secure coupling to the user's personal property (e.g., belt, bag or the like), while also permitting ready, relatively quick, and relatively easy removal of the wireless device for use. The coupling apparatus should permit both secure attachment to the user's personal property, while also allowing for quick and easy removal of the wireless device without disturbing the attachment to the personal property. The coupling apparatus should also be adaptable, so as to be useable with a different types of personal property. The present invention satisfies these needs and provides other, related, advantages.

SUMMARY OF THE INVENTION

It is an object of the present invention to provide a coupling apparatus and method for a wireless device that permits relatively quick removal of the wireless device for use, without disturbing the attachment of the coupling apparatus to the user's personal property.

It is a further object of the present invention to provide a coupling apparatus and method for a wireless device that permits relatively easy removal of the wireless device for use, without disturbing the attachment of the coupling apparatus to the user's personal property.

It is a still further object of the present invention to provide a coupling apparatus and method for a wireless device, that may be coupled to a variety of types of personal property.

BRIEF DESCRIPTION OF THE PREFERRED EMBODIMENTS

In accordance with one embodiment of the present invention, a wireless device carrying apparatus is disclosed. The apparatus comprises, in combination: a first mating portion having a first end and a second end; a second mating portion having a first end and a second end; a first magnet located proximate one of the first end of the first mating portion and the first end of the second mating portion; a first attachment mechanism adapted to be coupled to each of the second end of the first mating portion and a case for a wireless device; and a second attachment mechanism adapted to be coupled to each of the second end of the second mating portion and a personal item.

In accordance with another embodiment of the present invention, a wireless device carrying apparatus is disclosed. The apparatus comprises, in combination: a first mating portion having a first end and a second end; wherein the first end of the first mating portion is concave; a second mating portion having a first end and a second end; wherein the first end of the second mating portion is convex; a first magnet located proximate the first end of the first mating portion; a second magnet located proximate the first end of the second mating portion; a first attachment mechanism adapted to be coupled to each of the second end of the first mating portion and a case for a wireless device; and a second attachment mechanism adapted to be coupled to each of the second end of the second mating portion and a personal item.

In accordance with yet another embodiment of the present invention, a method for carrying a wireless device is disclosed. The method comprises the steps of: providing a first mating portion having a first end and a second end; wherein the first end of the first mating portion is concave; providing a second mating portion having a first end and a second end; wherein the first end of the second mating portion is convex; providing a first magnet located proximate the first end of the first mating portion; providing a second magnet located proximate the first end of the second mating portion; providing a first attachment mechanism adapted to be coupled to each of the second end of the first mating portion and a case for a wireless device; providing a second attachment mechanism adapted to be coupled to each of the second end of the second mating portion and a personal item; attaching the first attachment mechanism to each of the second end of the first mating portion and the case; attaching the second attachment mechanism to each of the second end of the second mating portion and the personal item; and bringing the first magnet into sufficient proximity to the second magnet so as to cause coupling of the first end of the first mating portion to the second end of the second mating portion.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
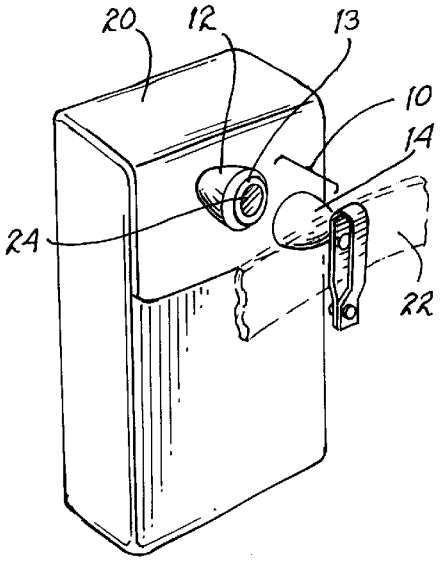
FIG. 1 is a perspective view of an embodiment of the coupling apparatus of the present invention.
Figure 2:
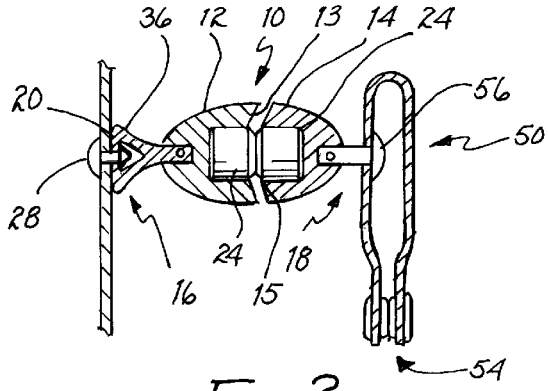
FIG. 2 is a side, cut-away view of the coupling apparatus of FIG. 1.
Figure 17:
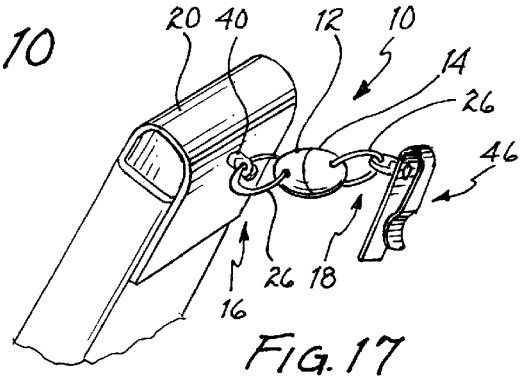
FIG. 17 is a perspective view of an embodiment of a fully-assembled coupling apparatus of the present invention, in use.

Referring first to FIGS. 1–2 and 17 an embodiment of a coupling apparatus 10 is shown. The coupling apparatus generally comprises the following: a first mating portion 12, a second mating portion 14, a first attachment mechanism 16, and a second attachment mechanism 18. The first mating portion 12 is coupled via the first attachment mechanism 16 to a wireless device case 20 or, alternatively, directly to the wireless device (not shown) contained therein. (The term "case" as used herein is intended to include either a removable case positioned over the exterior of a wireless device, or the outside of the wireless device itself.) The second mating portion 14 is coupled via the second attachment mechanism 18 to an item of personal property, such as a belt 22. (While a belt 22 is shown as an example of an item of personal property to which the second attachment mechanism 18 may be secured, it should be understood that it may be desirable to secure the second attachment mechanism 18 to other property, such as waist-band, a purse (including a purse strap), a pocket, etc.)

Referring now to FIGS. 2, 5–6, 8, and 11–13, attention is directed to the first and second mating portions 12 and 14. These portions are adapted to be coupled to each other about exposed surfaces 13 and 15, respectively. It is preferred, as shown herein, that exposed surface 13 be concave, and that exposed surface 15 be convex, so as to provide for more secure coupling therebetween. A magnet 24 is present on at least one surface 13 or 15. The other surface 13 or 15 has either a magnet 24 thereon (of opposite polarity to the one located on the opposing surface), or a metal surface of a type that is capable of being attracted to a magnet 24. When exposed surfaces 13 and 15 are brought into sufficient proximity with one another, attraction of the magnet 24 to either the second magnet 24 or the opposing metal surface will cause the first and second mating portions 12 and 14 to be coupled at exposed surfaces 13 and 15—as shown by way of example in FIGS. 2 and 17. Conversely, pulling on at least one of the first and second mating portions 12 and 14, typically caused by pulling away the case 20 from the belt 22 or other object to which the second mating portion 14 is coupled, will cause de-coupling of the first and second mating portions 12 and 14—and permit use of the wireless device in the case 20.

Referring now to FIGS. 1–6 and 8–17, attention is now directed to first attachment mechanism 16 and second attachment mechanism 18. In one embodiment, as shown by way of example in FIGS. 8, 11–13 and 17, a transverse opening 30 is provided through a rear portion of each attachment mechanism 16 and 18. Insertable through each transverse opening 30 is, optionally, a ring 26. (The ring 26 may, by way of example, be of the split ring type (see, e.g., FIG. 4), of the D-ring type, or of another desired type).

As shown in FIGS. 1–2, 8 and 17, and as noted above, it is preferred that the first mating portion 12 is coupled via the first attachment mechanism 16 to a case 20, and that the second mating portion 14 is coupled via the second attachment mechanism 18 to an item of personal property, such as a belt 22. (it should be apparent that the positions of the first and second mating portions 12 and 14 could be reversed.) Referring now to FIGS. 2, 3–6, 8–10, and 14–17, the first and second attachment mechanisms 16 and 18 are described in greater detail.

First, it should be noted that the purpose of the first attachment mechanism 16 is to couple the first mating potion 12 to the case 20. First, as shown in FIGS. 2, 5–6 and 9–10, it will be preferred to insert a pin 28 through the case 20. In one embodiment, the end of the pin 28 is inserted into the rear of the first mating portion 12 through longitudinal opening 29, where a transverse opening 32 in the pin 28 is aligned with the transverse opening 30, and the pin 28 is then secured by the insertion and secure coupling of a transverse pin 34 therein. See FIGS. 5–7. In another embodiment, the end of the pin 28 is inserted into the rear of a base member 36, which base member 36 is then securely coupled to the rear of the first mating portion 12. See FIG. 2. These configurations permit a relatively rigid positioning of the case 20 relative to the belt 22 or other item upon which the case 20 is worn, and limits movement of the case 20.

In another embodiment, the pin 28 is securely coupled to an O-type ring 38. See FIG. 8. In yet another embodiment, the pin 28 is securely coupled to a D-type ring 40. See FIG. 9. In this embodiments, coupling to the rear of the first mating portion 12 is accomplished by coupling a ring 26 to each of the O-type ring 38 or D-type ring 40 and through the transverse opening 30. See FIGS. 8 and 17. These configurations permit relatively freer movement of the case 20 during use.

Figure 3:
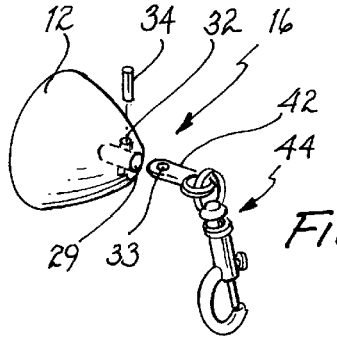
FIG. 3 is a perspective view of an embodiment of one component portion of the coupling apparatus of the present invention.
Figure 4:
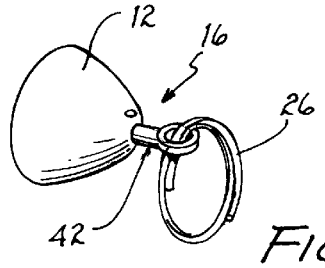
FIG. 4 is a perspective view of another embodiment of a component portion of the coupling apparatus of the present invention.
Figure 16:
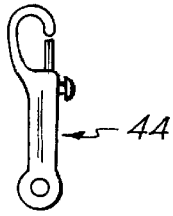
FIG. 16 is a side view of an embodiment of an attachment mechanism portion of the coupling apparatus of the present invention.

Referring now to FIGS. 3–4 and 16, in another configuration, the first mating portion 12 receives an eye-bolt 42 into the longitudinal opening 29, with the eye-bolt 42 being secured thereto with the insertion of transverse pin 34 through transverse opening 32 and through transverse opening 33 in the eye-bolt 42. The eye-bolt 42 has coupled to the ring portion thereof a ring 26 or a spring clip 44.

Referring now to FIGS. 1–2, 14–15 and 17, embodiments of the second attachment mechanism 18 are shown. In one embodiment, a belt clip 46 has an eyelet 48 thereon. The belt clip 46 may be clipped to a belt 22 or other personal item. In another embodiment, a loop 50 has an eyelet 52 thereon, and the loop 50 further has a snap assembly 54 to permit opening and closing of the loop 50 about a belt 22 or other personal item. (As shown in FIG. 2, instead of the eyelet 52, it would be possible to secure a pin 56 through the loop 50 and into the rear of the second mating portion 14.)

Figure 5:
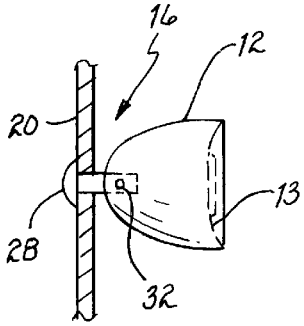
FIG. 5 is a side, cross-sectional view of an embodiment of one component portion of the coupling apparatus of the present invention.
Figure 6:
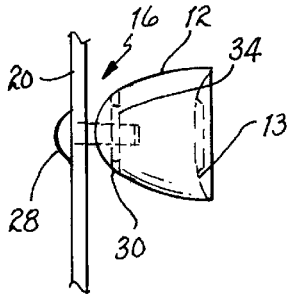
FIG. 6 is a side, cross-sectional view of an embodiment of one component portion of the coupling apparatus of the present invention.
Figure 7:
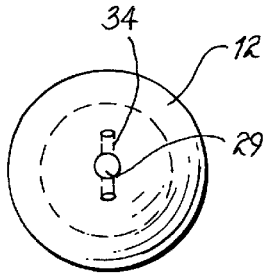
FIG. 7 is an end view of an embodiment of one component portion of the coupling apparatus of the present invention.
Figure 8:
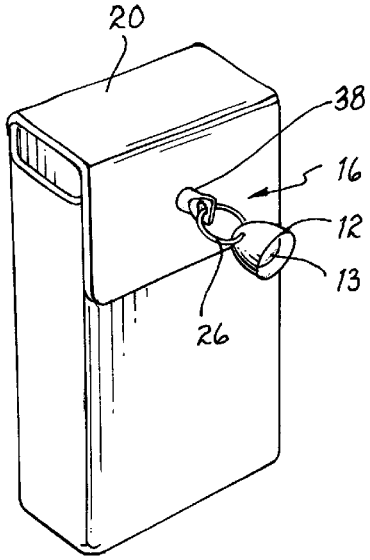
FIG. 8 is a perspective view of an embodiment of one component portion of the coupling portion of the present invention in position on a wireless device case.
Figure 11:
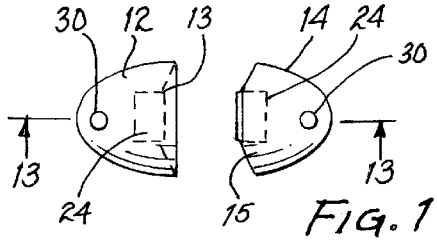
FIG. 11 is a side view of an embodiment of the mating portion components of the coupling apparatus of the present invention.
Figure 12:
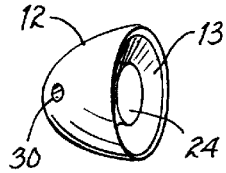
FIG. 12 is a perspective view of an embodiment of one mating portion component of the coupling apparatus of the present invention.
Figure 13:
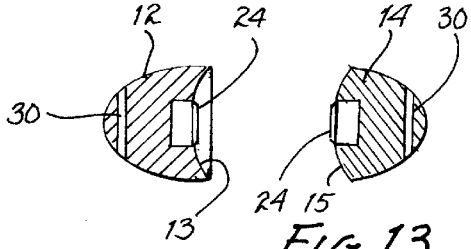
FIG. 13 is a side, cross-sectional view of an embodiment of the mating portion components of the coupling apparatus of the present invention.
Figure 9:
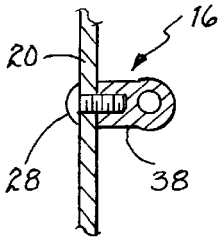
FIG. 9 is a side, cross-sectional view of an embodiment of an attachment mechanism portion of the coupling apparatus of the present invention.
Figure 14:
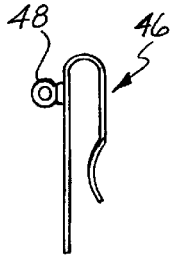
FIG. 14 is a side view of an embodiment of an attachment mechanism portion of the coupling apparatus of the present invention.
Figure 15:
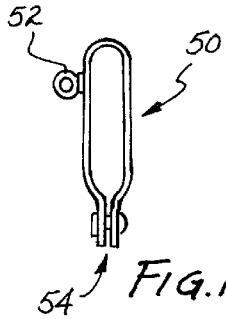
FIG. 15 is a side view of an embodiment of an attachment mechanism portion of the coupling apparatus of the present invention.
Figure 10:
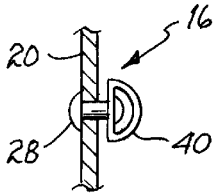
FIG. 10 is a side, cross-sectional view of an embodiment of an attachment mechanism portion of the coupling apparatus of the present invention.

It should be understood that, while different embodiments of the first and second attachment portions 16 and 18 are shown, each configuration could equally be used as a first attachment portion 16 or second attachment portion 18. For example, while FIGS. 5 and 6 illustrate an embodiment of a first attachment portion 16 coupled to a case 20, they could also illustrate a second attachment portion 18 coupled to a belt clip 46 or loop 50. The same would be accurate with respect to the embodiments shown in FIGS. 2–4 and 9–10.

While the invention has been particularly shown and described with reference to preferred embodiments thereof, it will be understood by those skilled in the art that the foregoing and other changes in form and details may be made therein without departing from the spirit and scope of the invention.

I claim:

1. A wireless device carrying apparatus comprising, in combination:

a first mating portion having a first end and a second end;

a second mating portion having a first end and a second end;

a first magnet located proximate one of said first end of said first mating portion and said first end of said second mating portion;

a first attachment mechanism adapted to be coupled to each of said second end of said first mating portion and a case for a wireless device; and a second attachment mechanism adapted to be coupled to each of said second end of said second mating portion and a personal item.

2. The carrying apparatus of claim 1 wherein said first end of said first mating portion is concave.

3. The carrying apparatus of claim 2 wherein said first end of said second mating portion is convex.

4. The carrying apparatus of claim 1 further comprising a second magnet located proximate the other of said first end of said first mating portion and said first end of said second mating portion.

5. The carrying apparatus of claim 1 wherein said first attachment mechanism comprises a pin inserted through said case and into a longitudinal opening in said second end of said first mating portion.

6. The carrying apparatus of claim 1 wherein said first attachment mechanism comprises:

a pin inserted through said case and coupled to a first ring; and a second ring coupled to said first ring;

wherein said second ring is inserted through a transverse opening in said second end of said first mating portion.

7. The carrying apparatus of claim 6 wherein said first ring is an O-type ring.

8. The carrying apparatus of claim 6 wherein said first ring is a D-type ring.

9. The carrying apparatus of claim 6 wherein said second ring is a split ring.

10. The carrying apparatus of claim 1 wherein said second attachment mechanism comprises:

a belt clip having an eyelet thereon; and a ring inserted through each of said eyelet and said second end of said second mating portion.

11. The carrying apparatus of claim 1 wherein said second attachment mechanism comprises:

a loop having an eyelet thereon; and a ring inserted through each of said eyelet and said second end of said second mating portion.

12. A wireless device carrying apparatus comprising, in combination:

a first mating portion having a first end and a second end;

wherein said first end of said first mating portion is concave;

a second mating portion having a first end and a second end;

wherein said first end of said second mating portion is convex;

a first magnet located proximate said first end of said first mating portion;

a second magnet located proximate said first end of said second mating portion;

a first attachment mechanism adapted to be coupled to each of said second end of said first mating portion and a case for a wireless device; and a second attachment mechanism adapted to be coupled to each of said second end of said second mating portion and a personal item.

13. The carrying apparatus of claim 12 wherein said first attachment mechanism comprises a pin inserted through said case and into a longitudinal opening in said second end of said first mating portion.

14. The carrying apparatus of claim 12 wherein said first attachment mechanism comprises:

a pin inserted through said case and coupled to a first ring; and a second ring coupled to said first ring;

wherein said second ring is inserted through a transverse opening in said second end of said first mating portion.

15. The carrying apparatus of claim 14 wherein said first ring is an O-type ring.

16. The carrying apparatus of claim 14 wherein said first ring is a D-type ring.

17. The carrying apparatus of claim 14 wherein said second ring is a split ring.

18. The carrying apparatus of claim 12 wherein said second attachment mechanism comprises:

a belt clip having an eyelet thereon; and a ring inserted through each of said eyelet and said second end of said second mating portion.

19. The carrying apparatus of claim 12 wherein said second attachment mechanism comprises:

a loop having an eyelet thereon; and a ring inserted through each of said eyelet and said second end of said second mating portion.

20. A method for carrying a wireless device, comprising the steps of:

providing a first mating portion having a first end and a second end;

wherein said first end of said first mating portion is concave;

providing a second mating portion having a first end and a second end;

wherein said first end of said second mating portion is convex;

providing a first magnet located proximate said first end of said first mating portion;

providing a second magnet located proximate said first end of said second mating portion;

providing a first attachment mechanism adapted to be coupled to each of said second end of said first mating portion and a case for a wireless device;

providing a second attachment mechanism adapted to be coupled to each of said second end of said second mating portion and a personal item;

attaching said first attachment mechanism to each of said second end of said first mating portion and said case;

attaching said second attachment mechanism to each of said second end of said second mating portion and said personal item; and bringing said first magnet into sufficient proximity to said second magnet so as to cause coupling of said first end of said first mating portion to said second end of said second mating portion.

* * * * *